US006360708B2

(12) United States Patent
Hwang et al.

(10) Patent No.: US 6,360,708 B2
(45) Date of Patent: Mar. 26, 2002

(54) INTAKE SYSTEM

(75) Inventors: Seon-Yang Hwang, Anyang; Tae-Ho Kwon, Seoul, both of (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/752,424

(22) Filed: Dec. 27, 2000

(30) Foreign Application Priority Data

Dec. 28, 1999 (KR) ..... 99-63719

(51) Int. Cl.[7] ..... F02M 35/10
(52) U.S. Cl. ..... 123/184.57
(58) Field of Search ..... 123/184.57

(56) References Cited

U.S. PATENT DOCUMENTS 5,107,800 A * 4/1992 Araki et al. ..... 123/184.57
5,522,367 A * 6/1996 Reuschenbach et al. .... 123/492
5,575,257 A * 11/1996 Lange et al. ..... 123/337.11
5,957,102 A * 9/1999 Schorn ..... 123/184.57
6,105,546 A * 8/2000 Fuesser et al. ..... 123/184.57
6,109,249 A * 8/2000 Wild et al. ..... 123/568.21

* cited by examiner

*Primary Examiner*—Marguerite McMahon
(74) *Attorney, Agent, or Firm*—Christie, Parker & Hale, LLP

(57) ABSTRACT

An intake system adapted and constructed to reduce noise without change or alternation to existing structure, the system comprising: an intake duct formed for intake of air; a resonator formed at one side of the intake duct; a flow passage connected to the intake duct for air to be infused from the intake duct; a main valve formed in the flow passage for controlling amount of air infused from the intake duct; a throttle body mounted with an idle speed actuator formed at an air route communicatively equipped at the flow passage for controlling the amount of air; and a connecting member for connecting the air route and the resonator.

1 Claim, 1 Drawing Sheet

INTAKE SYSTEM

CROSS-REFERENCE TO RELATED APPLICATION

This application claims priority of Korea patent application No. 1999-63719, filed on Dec. 28, 1999.

BACKGROUND OF THE INVENTION

1. Field of the Invention

The present invention relates to an intake system, and more particularly to an intake system adapted to improve air current sound generated by air passing through a throttle body.

2. Description of the Prior Art

In general, air infused into an engine flows in the follow fashion. In other words, the air filtered by an air cleaner is adjusted in volume thereof by open duct at a throttle valve disposed in the throttle body and sucked into a cylinder through each manifold.

Particularly, the throttle body includes a throttle valve for controlling sucked air amount, a bypass system for bypassing a predetermined amount of air for obtaining idling rotating speed, a throttle position sensor for detecting a throttle valve open duct and a dash pat.

As illustrated in FIG. 1, the throttle body thus constructed serves to control air amount necessary for maintaining a resolution per minute (RPM) according to an idle speed actuator 11 during idling. At this time, there is generated an air current sound of white noise while the air passes the idle speed actuator 11. The generated noise is amplified in a surge tank (not shown) to be radiated and heard at the outside. Meanwhile, unexplained reference numeral 12 in FIG. 1 is a main valve for controlling air amounted at synchronization.

The air current sound thus created in idling, which is heard loudly especially in cold, freezing weather, can be reduced by improvement in idle speed actuator 11 itself, mounting an air controller in flow passage or thickening wall thickness of surge tank.

However, there is a problem in that thickened wall of surge tank increases weight, manufacturing cost and involves a manufacturing difficulty.

SUMMARY OF THE INVENTION

The present invention is disclosed to solve the aforementioned problems and it is an object of the present invention to provide an intake system adapted and constructed to reduce noise without change or alteration to existing structure.

In accordance with the object of the present invention, there is provided an intake system, the system comprising:

an intake duct formed for intake of air;

a resonator formed at one side of the intake duct;

a flow passage connected to the intake duct for air to be infused from the intake duct;

a main valve formed in the flow passage for controlling amount of air infused from the intake duct;

a throttle body mounted with an idle speed actuator formed at an air route communicatively equipped at the flow passage for controlling the amount of air; and a connecting member for connecting the air route and the resonator.

The air route according to the present invention communicate at one end thereof with the flow passage while the other end thereof comes out of the flow passage to have the idle speed actuator installed at one side thereof with the connecting member equipped at the other side thereof.

BRIEF DESCRIPTION OF THE DRAWINGS

For fuller understanding of the nature and object of the invention, reference should be made to the following detailed description taken in conjunction with the accompanying drawings in which.

DETAILED DESCRIPTION OF THE INVENTION

Now, preferred embodiment of the present invention will be described in detail with reference to the accompanying drawings.

Figure 1:
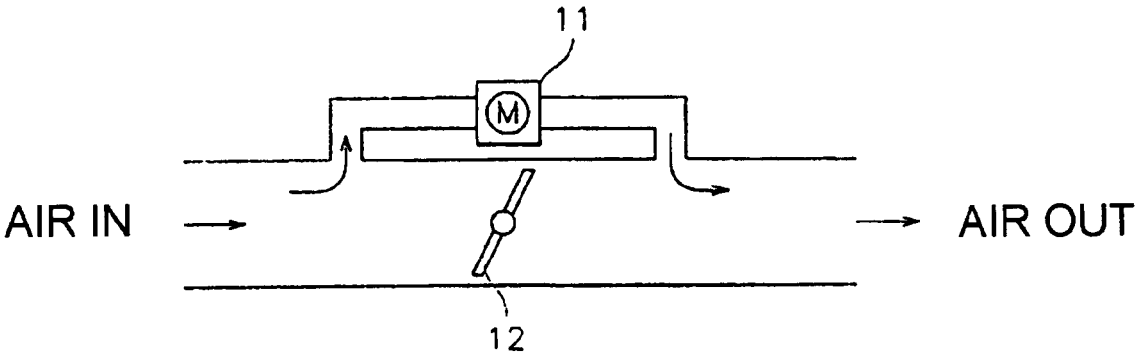
FIG. 1 (prior art)
FIG. 1 is a schematic drawing for partially illustrating a throttle body according to the prior art.
Figure 2:
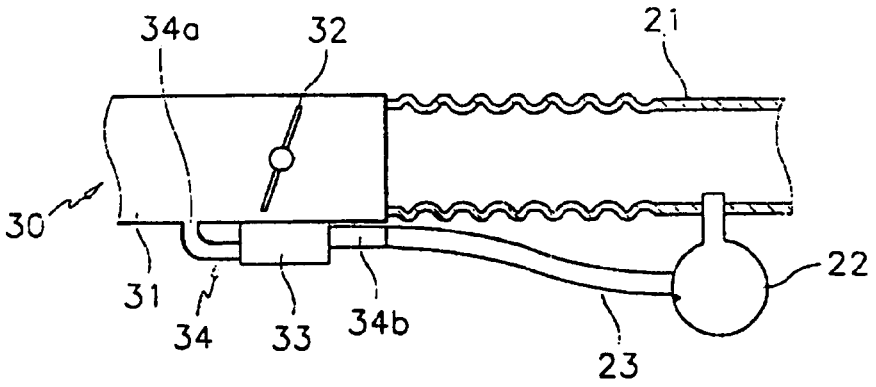
FIG. 2 is a schematic drawing for partially illustrating an intake system according to the present invention.

FIG. 2 is a schematic drawing for partially illustrating an intake system according to the present invention.

As illustrated in the drawings, the intake system according to the present invention describes a structure where an air current sound generated by air passing through a throttle body is reduced with change or alternation to existing construction.

At this time, an intake system according to the prior art will be eliminated in description thereof while only an intake system according to the present invention will be described in detail.

The intake system according to the present invention includes an intake duct 21 formed for intake of air, a cavity resonator formed at one side of the intake duct 21, a flow passage 31 connected to the intake duct 21 for air to be infused from the intake duct 21; a main valve 32 formed in the flow passage for controlling the amount of air infused from the intake duct 21, a throttle body 30 mounted with an idle speed actuator 33 formed at an air route or passage 34 communicatively equipped at the flow passage 31 for controlling the amount of air; and a connecting member 23 for connecting the air route 34 and the resonator 22.

The air route 34 communicates at one end thereof 34*a* with flow passage 31 while the other end thereof 34*b* comes out of the flow passage 31 to have the idle speed actuator 33 installed at one side thereof with the connecting member 23 equipped at the other side thereof 34*b*.

Now, operation of intake system according to the present invention thus constructed will be described. At this time, operation of a general intake system will be omitted in explanation thereof but operation of intake system according to the present invention will be described.

Referring again to FIG. 2, there connecting member 23 which is a hose is pulled out from the noise-removing resonator 22 formed at the intake duct 21 to be directly connected to the throttle body 30. Particularly, the air route 34 is exposed out of the flow passage 31 not to be connected again to the flow passage 31 but to be directly connected to the resonator 22 through the connecting member 23, such that the throttle body 30 becomes simplified in structure thereof.

In other words, the throttle body 30 is connected to the resonator (noise remover) 22 which has only particular source due to effect of blocking from outside noise according to increased internal air impedance, noise generated by surge tank according to internal noise and the like, such that air current sound, accelerated engine noise and the like can be all removed.

As apparent from the foregoing, there is an advantage in the intake system thus described according to the present invention in that the resonator mounted on the intake duct improves anti-part of performance curve to thereby connect a first flow speed torque and a second high speed torque directly, improving a driving stillness according to decreased noise.

There is another advantage in that the throttle body is simplified in structure thereof to reduce a manufacturing cost and discharge of exhaust gas, and to improve fuel consumption rate.

Having described preferred embodiments of the invention with reference to the accompanying drawing, it is to be understood that the various changes and modifications may be effected therein by one skilled in the art without departing from the scope or spirit of the invention as defined in the appended claims.

What is claimed is:

1. An intake system, the system comprising:

an intake duct for the intake of air;

a cavity resonator disposed adjacent to, and in fluid communication with, one end of the intake duct;

a throttle body, the throttle body having a flow passage connected to another end of the intake duct, wherein air is drawn into the flow passage of the throttle body via the intake duct;

a main valve disposed within the flow passage of the throttle body for controlling the volume of air drawn into the throttle body;

an idle speed actuator;

an air passage having one end connected to the throttle body and another end connected to one end of the idle speed actuator; and an air hose, wherein the air hose connects another end of the idle speed actuator to the resonator.

* * * * *